US010675647B2

(12) United States Patent
Kim et al.

(10) Patent No.: US 10,675,647 B2
(45) Date of Patent: Jun. 9, 2020

(54) DISCHARGE CONTAINER FOR HETEROGENEOUS CONTENTS

(71) Applicant: YONWOO CO., LTD, Incheon (KR)

(72) Inventors: Sang-Hyung Kim, Incheon (KR); Hun Bong, Incheon (KR)

(73) Assignees: YONWOO CO., LTD., Incheon (KR); PKG GROUP, LLC, Beverly Hills, CA (US)

( * ) Notice: Subject to any disclaimer, the term of this patent is extended or adjusted under 35 U.S.C. 154(b) by 0 days.

(21) Appl. No.: 16/478,631

(22) PCT Filed: Jan. 12, 2018

(86) PCT No.: PCT/KR2018/000604
§ 371 (c)(1),
(2) Date: Jul. 17, 2019

(87) PCT Pub. No.: WO2018/035814
PCT Pub. Date: Jul. 26, 2018

(65) Prior Publication Data

US 2019/0337000 A1 Nov. 7, 2019

(30) Foreign Application Priority Data

Jan. 23, 2017 (KR) ..... 10-2017-0010265

(51) Int. Cl.
*B05B 11/00* (2006.01)
*B05B 11/02* (2006.01)
*B65D 81/32* (2006.01)

(52) U.S. Cl.
CPC ..... *B05B 11/3084* (2013.01); *B05B 11/0038* (2018.08); *B05B 11/02* (2013.01); *B65D 81/3227* (2013.01)

(58) Field of Classification Search
CPC . B05B 11/3084; B05B 11/0038; B05B 11/02; B65D 81/3227
(Continued)

(56) References Cited

U.S. PATENT DOCUMENTS 3,550,813 A * 12/1970 Lehmann ..... B65D 83/682 222/94
6,082,588 A * 7/2000 Markey ..... B05B 11/3084 222/135
(Continued)

FOREIGN PATENT DOCUMENTS

JP 2003-034376 A 2/2003
KR 10-2012-0061258 A 6/2012
(Continued)

*Primary Examiner* — Benjamin R Shaw
(74) *Attorney, Agent, or Firm* — John K. Park; Park Law Firm

(57) ABSTRACT

The present invention disclosed herein relates to a discharge container for heterogeneous contents, which configured such that the pumping operations of a first pumping member and a second pumping member are achieved by manipulating one button member, and a first content and a second content are simultaneously discharged separately to be used, wherein a button support for supporting the button member at both sides of the button member guides the vertical movement of the button member, whereby the button operation can be stably performed.

4 Claims, 7 Drawing Sheets

(58) Field of Classification Search
USPC ..... 222/137, 145.3, 136
See application file for complete search history.

(56) References Cited

U.S. PATENT DOCUMENTS

| | | | | |
|---|---|---|---|---|
| 6,672,483 | B1 * | 1/2004 | Roy | B05B 11/0038 222/145.1 |
| 2003/0146242 | A1 * | 8/2003 | Peterson | B05B 11/0078 222/137 |
| 2006/0065674 | A1 * | 3/2006 | Lasserre | B65D 83/68 222/137 |
| 2007/0289999 | A1 * | 12/2007 | Rossignol | B05B 11/0078 222/137 |
| 2013/0175297 | A1 * | 7/2013 | Sugimoto | B65D 83/206 222/135 |

FOREIGN PATENT DOCUMENTS

| | | | |
|---|---|---|---|
| KR | 10-1440018 | B1 | 9/2014 |
| KR | 10-2014-0122386 | A | 10/2014 |
| KR | 20-0478341 | Y1 | 9/2015 |
| KR | 10-2016-0008340 | A | 1/2016 |

* cited by examiner

DISCHARGE CONTAINER FOR HETEROGENEOUS CONTENTS

BACKGROUND OF THE INVENTION

The present invention disclosed herein relates to a discharge container for heterogeneous contents, which configured such that the pumping operations of a first pumping member and a second pumping member are achieved by manipulating one button member, and a first content and a second content are simultaneously discharged separately to be used, wherein a button support for supporting the button member at both sides of the button member guides the vertical movement of the button member, whereby the button operation can be stably performed.

Generally, among cosmetic contents, there are some contents that may have a synergy effect when used after being mixed, but there are other contents that, when mixed and received in one container from the beginning, coagulation and precipitation due to physical and chemical reactions can cause a poor discharging of contents, or even discoloration or decomposition of contents can occur. Therefore, it is recommended to store contents into an individual container respectively and then to mix when they are used. For example, prescribed liquid cosmetics, vitamins effective for whitening, skin reproduction, removing wrinkles and the like, ordinary sol-type toothpastes, sol or gel types toothpastes having good penetration effect or good scents, or shampoos and rinses belong to this category.

Since those contents listed in the above are usually held in a separate container and sold, a user uses contents, which have excellent effect when used together, from different containers one by one. Therefore, it makes users feel inconvenient when using those containers.

To solve these problems in the above, "a container for heterogeneous contents', which equips a pair of cartridges storing respectively each of heterogeneous contents inside of the housing, is disclosed in the Korean registered patent no. 20-0477046. (Hereafter it is called "the patent document 1".)

The patent document discloses a container for heterogeneous contents comprising: a housing having a cylinder shape with both ends open; fastening ribs provided at the opened ends of the housing; at least a pair of cartridges rotatably equipped to the housing in a state of facing each other; a dodging groove extending to a engaging groove from the upper end of each of the cartridges; engaging grooves formed at each outer circumferential surface of the cartridge and interlocked to the fastening ribs, characterized in that, when the cartridges are coupled as facing each other, the engaging grooves are arranged along the circumferential direction and the cartridges are inserted and coupled to the upper ends from the housing, in that when the cartridges are coupled to the housing, the engaging ribs enter the engaging grooves through the dodging grooves, and in that when the cartridges are rotated in a state of the engaging ribs entering respectively each of the engaging grooves, the engaging ribs move along the engaging grooves against the cartridges.

Since the patent document 1 is composed of dual containers storing each of heterogeneous contents inside of the housing, it brings user convenience in that a user does not have to use each container when using heterogeneous contents one by one. However, it is configured in that heterogeneous contents stored a pair of cartridges are discharged when manipulating each of a pair of operating members; therefore, it still has a problem of user inconveniences.

SUMMARY OF THE INVENTION

The present invention is devised to solve the said problems above, and its goal is to provide a discharge container for heterogeneous contents, which is configured such that the pumping operations of a first pumping member and a second pumping member are achieved by manipulating one button member, and a first content and a second content are simultaneously discharged separately so as to use the same, wherein a button support for supporting the button member on both sides of the button member guides the vertical movement of the button member, whereby the button operation can be stably performed.

To solve the problems described in the above, a container for heterogeneous contents according to embodiments of the present invention includes: a container body where liquid-type contents are stored; a first container and a second container disposed side by side at the right and the left side at the inner side of the container body and storing a first content and a second content; a first pumping member and a second pumping member, coupled respectively to the upper portion of the first container and the second container and discharging contents through pumping operation; a fixation body coupled to the upper portion of the container body and fixing the first pumping member and the second pumping member to the first container and the second container; a content movement part coupled to the upper portion of the first pumping member and the second pumping member and forming a movement passage of the first content and the second content which move to the upper portion thereof through pumping operation of the first pumping member and the second pumping member; a button member coupled to the upper portion of the content movement part and delivering the pressure to the content movement part according to user's pressurization and guiding the first pumping member and the second pumping member to pump simultaneously and forming a first discharge hole and a second discharge hole at the front surface thereof such that the first content and the second content can be respectively discharged, and forming a first space and a second space at the inner side thereof such that the first content and the second content being discharged respectively through the first discharge hole and the second discharge hole can be stored; and a button support body, coupled to the fixation body as encasing the button member and protrusively forming a button support protrusion that supports the button member at both sides of the button member such that vertical movement of the button member can be guided.

Furthermore, it is characterized in that at the upper inner side of the button member is provided a separator which extends downwards and separates the first space and the second space such that the first content and the second content can be separately stored, and at the upper end of the content movement part is formed an insertion groove where the separator is inserted.

Furthermore, it is characterized in that the button member includes a fixation part fitted into the content movement part, a pressurization part protrusively formed upwards from the center portion of the fixation part, and an extension part having a shape corresponding to the button support protrusion and respectively extending to the front and the back of the pressurization part Furthermore, it is characterized in that at the button support protrusion is formed a separation preventing protrusion which supports the upper end of the fixation part of the button member such that the button member is not prevented from being separated upwards.

Furthermore, it is characterized in that at the content movement part is formed a fixation groove which encasing the inner circumferential surface of the content movement part such that the fixation part of the button member can be fitted into.

Furthermore, it is characterized in that at the inner side of the extension part is provided a coupling protrusion which guides the assembly direction of the button member and the content movement part, and at the front surface of the content movement part is formed a coupling groove where the coupling protrusion is coupled.

Furthermore, it is characterized in that at the upper end of the content movement part are formed a first movement groove and a second movement groove which guide a first content and a second content, moving to the upper portion thereof through pumping operation of the first pumping member and the second pumping member, can respectively move to the first space and the second space.

Furthermore, it is characterized in that at the inner side of the button member is provided a guide protrusion which assists the vertical movement of the content movement part, in a process that the button member ascends and descends according to the presence or the absence of the pressurization of the button member, such that the content movement part can move along together.

As described in the above, the present invention has a configuration wherein the pumping operations of a first pumping member and a second pumping member are achieved by manipulating one button member, and the first content and the second content are simultaneously discharged separately to be used, wherein a button support for supporting the button member on both sides of the button member guides the vertical movement of the button member, whereby the button operation can be stably performed.

DETAILED DESCRIPTION OF PREFERRED EMBODIMENTS

Figure 1:
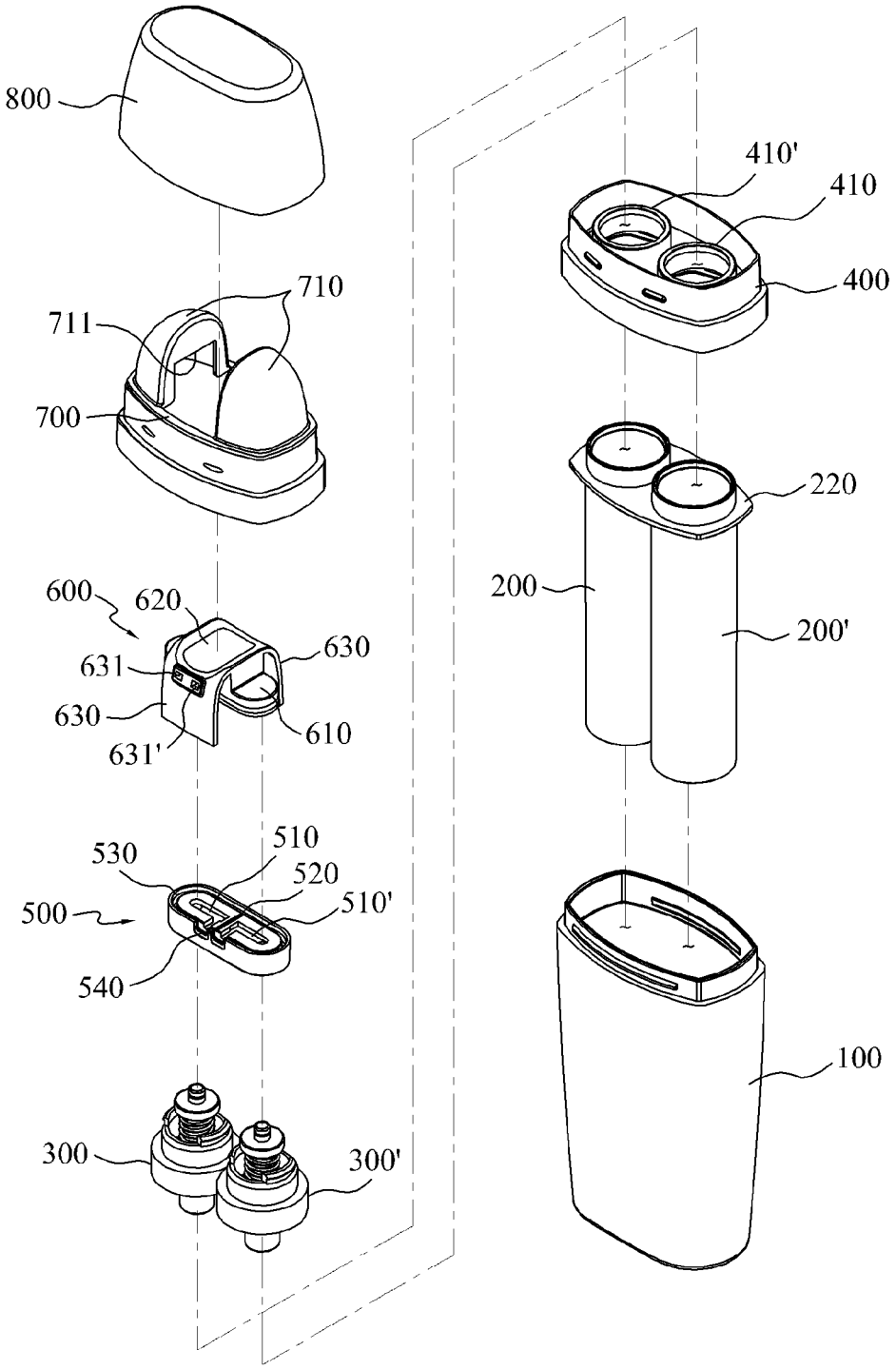
FIG. 1 is an exploded perspective view illustrating a configuration of a discharge container for heterogeneous contents according to an exemplary embodiment of the present invention.

Hereinafter, the present invention will be described in detail with reference to accompanying drawings. The same reference numerals provided in the drawings indicate the same members.

Figure 2:
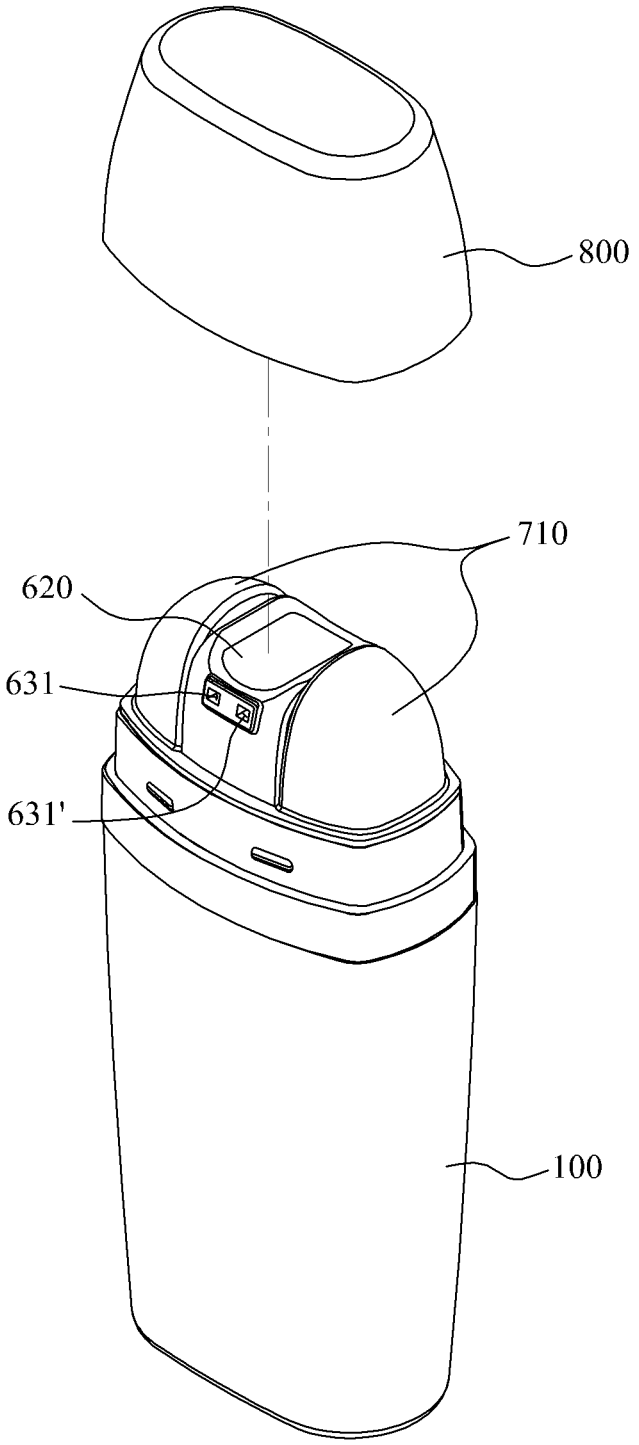
FIG. 2 is an assembled perspective view illustrating a configuration of the discharge container for heterogeneous contents according to an exemplary embodiment of the present invention.

FIG. 1 is an exploded perspective view illustrating a configuration of a discharge container for heterogeneous contents according to an exemplary embodiment of the present invention. FIG. 2 is an assembled perspective view illustrating a configuration of the discharge container for heterogeneous contents according to an exemplary embodiment of the present invention.

Figure 3:
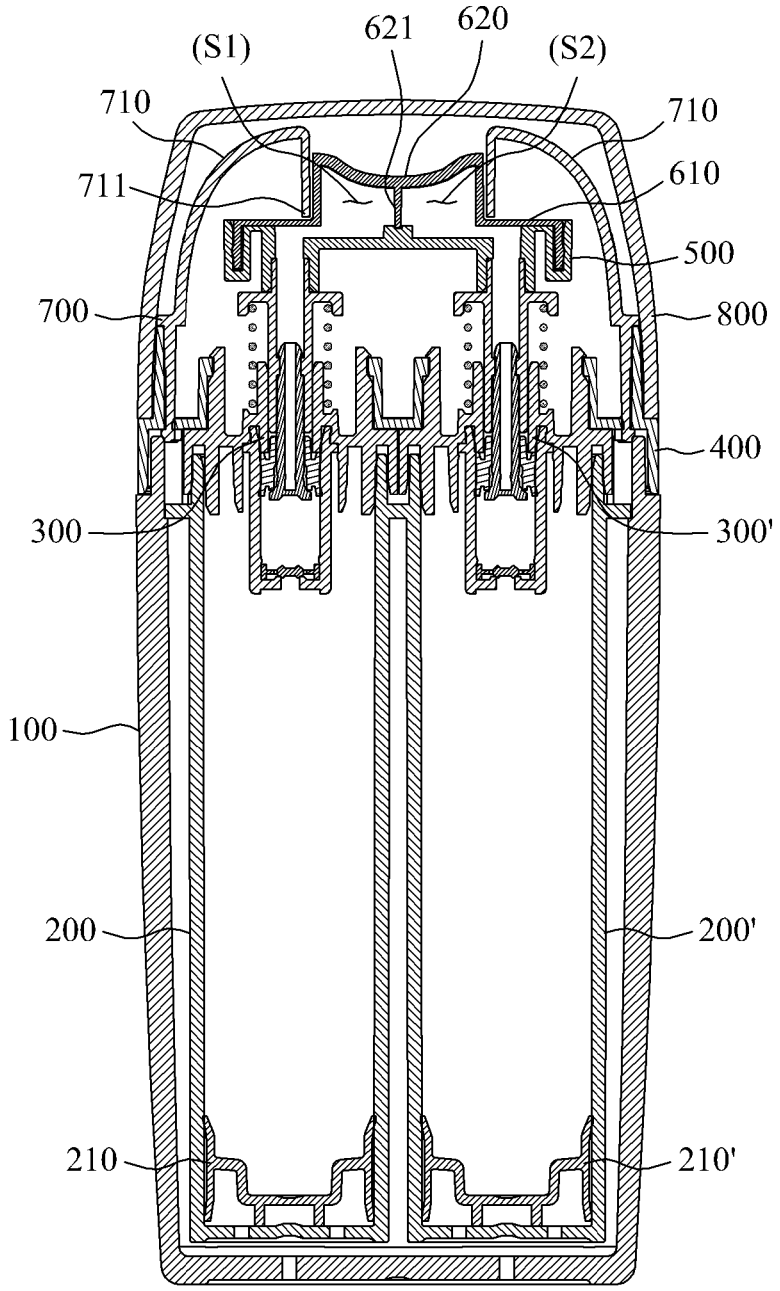
FIG. 3 is an assembled cross-sectional view illustrating a configuration of the discharge container for heterogeneous contents according to an exemplary embodiment of the present invention.
Figure 4:
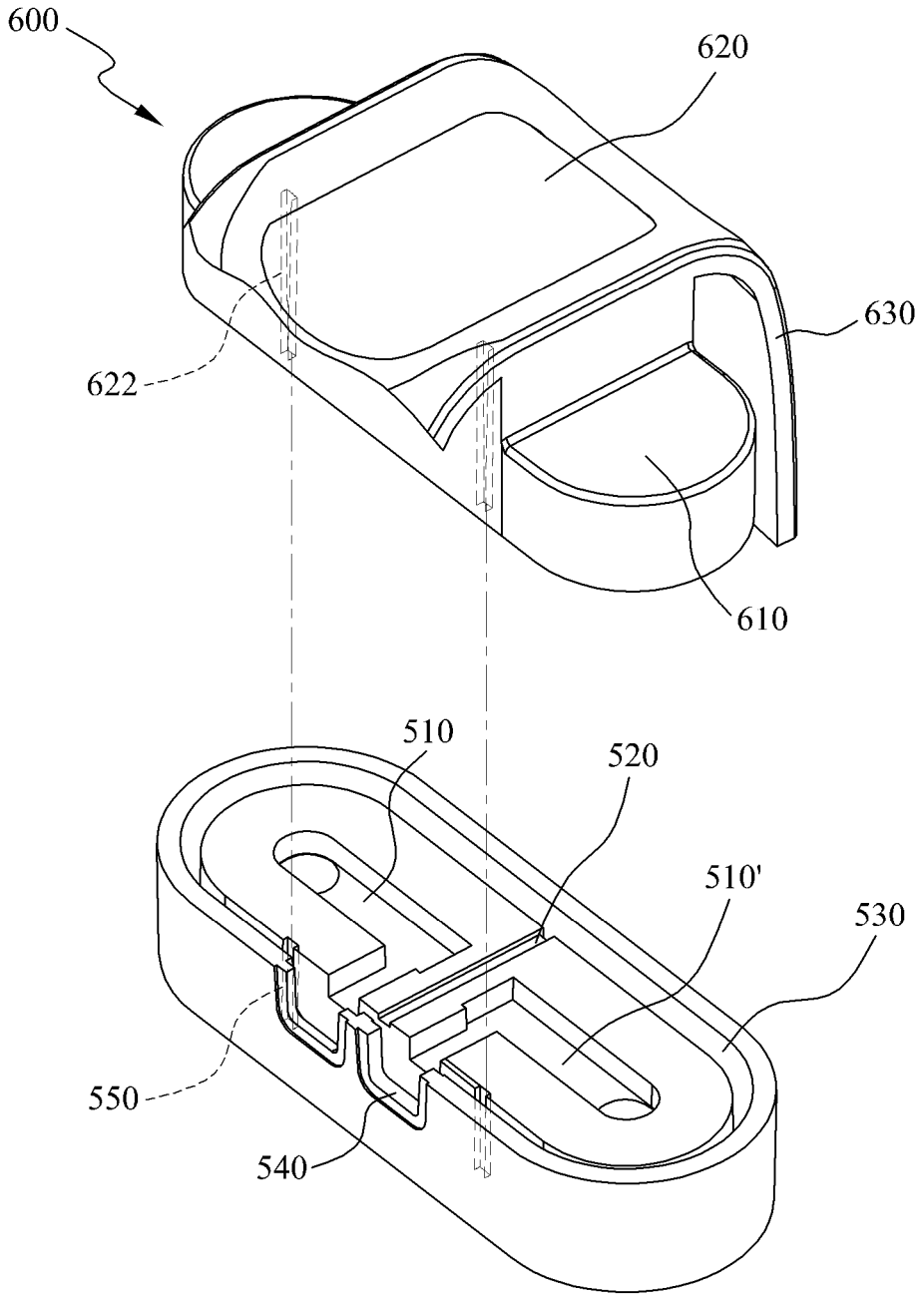
FIG. 4 is a schematic diagram illustrating a configuration of a content movement part and a button member of the discharge container for heterogeneous contents according to an exemplary embodiment of the present invention.

FIG. 3 is an assembled cross-sectional view illustrating a configuration of the discharge container for heterogeneous contents according to an exemplary embodiment of the present invention. FIG. 4 is a schematic diagram illustrating a configuration of a content movement part and a button member of the discharge container for heterogeneous contents according to an exemplary embodiment of the present invention.

Referring to FIGS. 1 to 4, a discharge container for heterogeneous contents according to an exemplary embodiment of the present invention includes: a container body 100, a first container and a second container 200, 200', a first pumping member and a second pumping member 300, 300', a fixation body 400, a content movement part 500, a button member 600, and a button support body 700.

The container body 100, which receives a first container and a second container 200, 200' where a first content and a second content are respectively stored, has the upper end thereof open such that the first container and the second container 200, 200' can be received thereto and has an air movement hole at the lower end formed such that air can flow to the inside of the container body 100.

The first container and the second container 200, 200', disposed side by side at the right and the left at the inner side of the container body 100 and storing respectively the first content and the second content therein, are provided with a first piston and a second piston 210, 210' which ascend according to the usage of the first content and the second content at the lower portion thereof.

At the upper portion of the first container and the second container 200, 200' is provided a connection member 220 which connects the first container and the second container 200, 200' in a state of being contacted to the inner side of the container body 100 such that the first container and the second container 200, 200' can be prevented from moving inside the container body 100.

The first pumping member and the second pumping member 300, 300' are coupled to the upper portion of the first container and the second container 200, 200 respectively, and discharge contents through pumping operation by pressurization of a button member 600 by a user. However, detailed configuration of the first pumping member and the second pumping member 300, 300' will be omitted because it is a prior art in the field of the present invention.

The fixation body 400, coupled to the upper portion of the container body 100 and fixing the first pumping member and the second pumping member 300, 300' to the first container and the second container 200, 200' respectively, is provided with a first fixation tube and a second fixation tube 410, 410' such that the first pumping member and the second pumping member 300, 300' can be penetrated through therein.

The fixation body 400 is detachably coupled with an over cap 800 which encases the button member 600 and the button support body 700.

The content movement part 500 is coupled to the upper portion of the first pumping member and the second pumping member 300, 300' respectively, and forms a movement passage of the first content and the second content moving to the upper portion thereof through pumping operation of the first pumping member and the second pumping member 300, 300'. The content movement part 500 is formed, at the upper end thereof, with a first movement groove and a second movement groove 510, 510' which guide the first content and the second content moving to the upper portion through pumping operation of the first pumping member and the second pumping member 300, 300' to move respectively to a first space and a second space S1. S2.

Furthermore, at the upper end of the content movement part 500 is formed an insertion groove 520 such that a separator 621 for separating the inner space of the button member 600 can be inserted, and is formed a fixation groove 530 which encases the inner circumferential surface thereof such that the fixation part 610 of the button member 600 can be fitted into therein.

Meanwhile, at the front surface of the content movement part 500 is formed a coupling groove 540 where a coupling protrusion 632 of the extension part 630 is coupled so as to provide a direction when coupling with the button member 600.

Furthermore, at the content movement part 500 is formed a guide groove 550 where a guide protrusion 622 of the button member 600 such that the content movement part 500 can move vertically along with the button member 600 without being tilted either side according to the presence or absence of pressurization of the button member 600.

The button member 600, coupled to the upper portion of the content movement part 500 and delivering the pressure according to a user's pressurization to the content movement part 500, and guiding the first pumping member and the second pumping member 300, 300' to perform pumping operation simultaneously, includes a fixation part 610, a pressurization part 620, and an extension part 630.

The fixation part 610, fitted into the content movement part 500, is configured to correspond to the size of the content movement part 500 such that the fixation part 610 can be fitted to a fixation groove 530 as encasing the inner circumferential surface of the content movement part 500.

The pressurization part 620 is protrusively formed to the upward from the center of the fixation part 610 and performed by a user's pressurization with the finger. Furthermore, the present invention is characterized in that the pressurization part 620 is provided with a separator 621 which extends downwards and separates the first space S1 and the second space S2 such that the first content and the second content can be separately stored.

The separator 621, whose lower end is inserted into an insertion groove 520 of the content movement part 500 and separates the first space S1 where the first content is stored and the second space S2 where the second content is stored, thereby preventing the first content and the second content from being mixed inside the button member 600.

Furthermore, at the inner side of the pressurization part 620 is provided a guide protrusion 622 which assists a vertical movement such that the button member 600 can vertically move along together with the content movement part 500 in a process of the button member 600 ascending and descending by the presence or the absence of pressurizing the pressurization part 620.

The extension part 630 corresponds to the shape of the button support protrusion 710 of the button support body 700 and extends downwards respectively at the front surface and the rear surface of the pressurization part 620. At the extension part 630 located on the front surface thereof is formed with a first discharge hole and a second discharge hole 631, 631' such that the first content and the second content can be respectively discharged.

Furthermore, at the inner side of the extension part 630 is provided a coupling protrusion 632 coupled to a coupling groove 540 of the content movement part 500, thereby guiding an assembly direction of the content movement part 500 and the button member 600.

The button support body 700 encases the button member 600 and is coupled to the fixation body 400 and supports the button member 600. Furthermore, the present invention is characterized in that the button support body 700 is protrusively formed with a button support protrusion 710 to the upward direction which supports the pressurization part 620 at both sides of the pressurization part 620 for guiding the button member 600 to move vertically.

The button support protrusion 710 supports the pressurization part 620 at both sides thereof, whereby the pressurization part 620 can move vertically without tilting to either side when a user pressurizes the pressurization part 620.

Furthermore, the button support protrusion 710 has the lower portion thereof cut open and forms a separation preventing protrusion 711 such that the fixation part 610 of the button member 600 can be inserted therein, wherein the separation preventing protrusion 711 supports the upper end of the fixation part 610 of the button member 600 and thereby prevent the button member 600 from being separated upwards.

Hereafter, with reference to FIGS. 5 to 7, a content discharging process of the discharge container for heterogeneous contents according to an exemplary embodiment of the present invention will be described.

Figure 5:
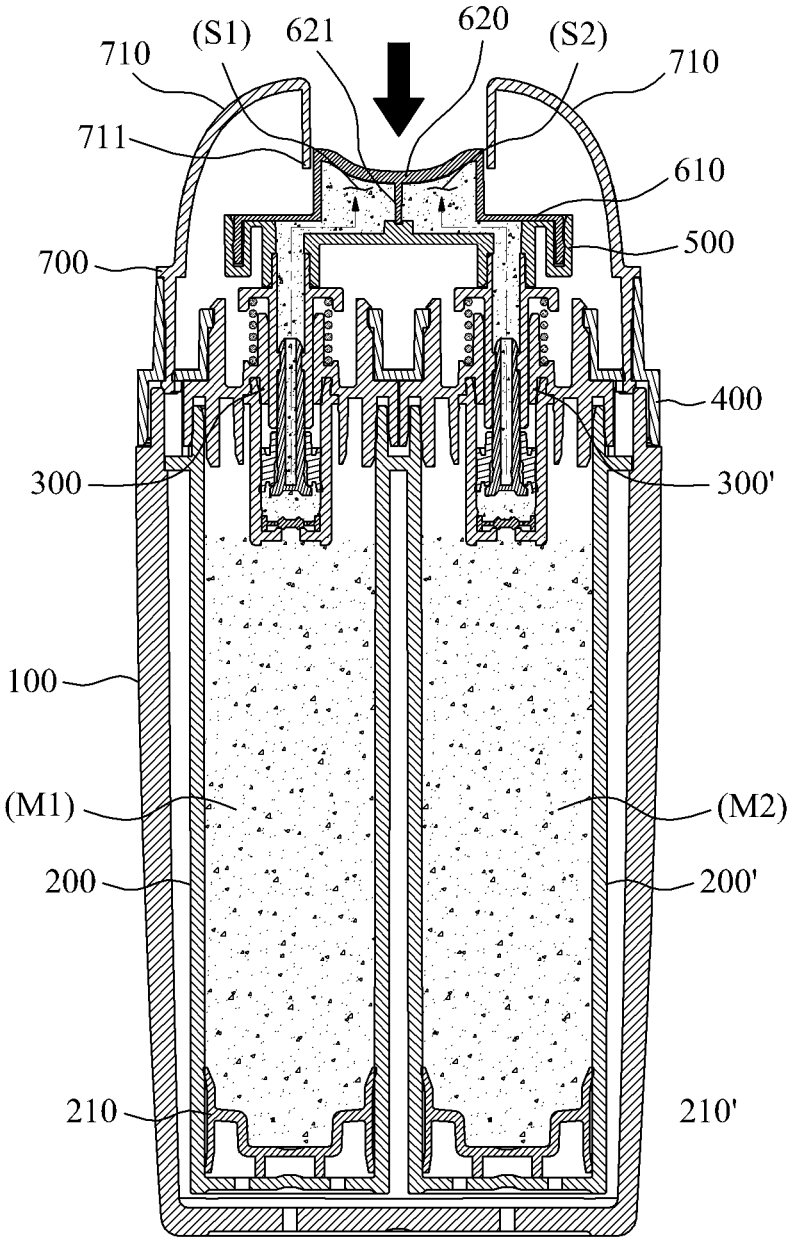
FIGS. 5 to 7 are explanatory diagrams illustrating a process of content discharging of the discharge container for heterogeneous contents according to an exemplary embodiment of the present invention.
Figure 6:
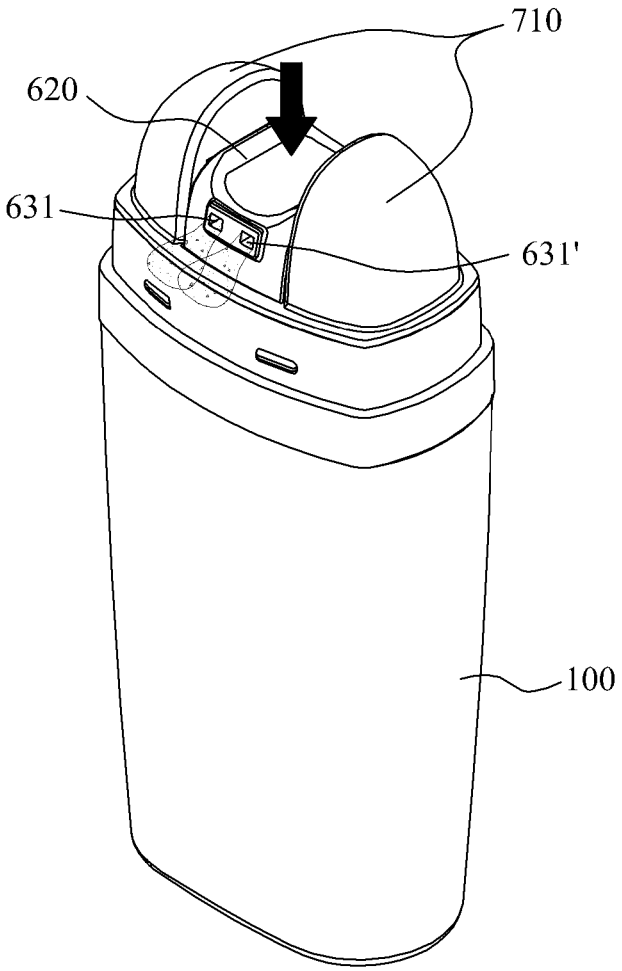
Figure 7:
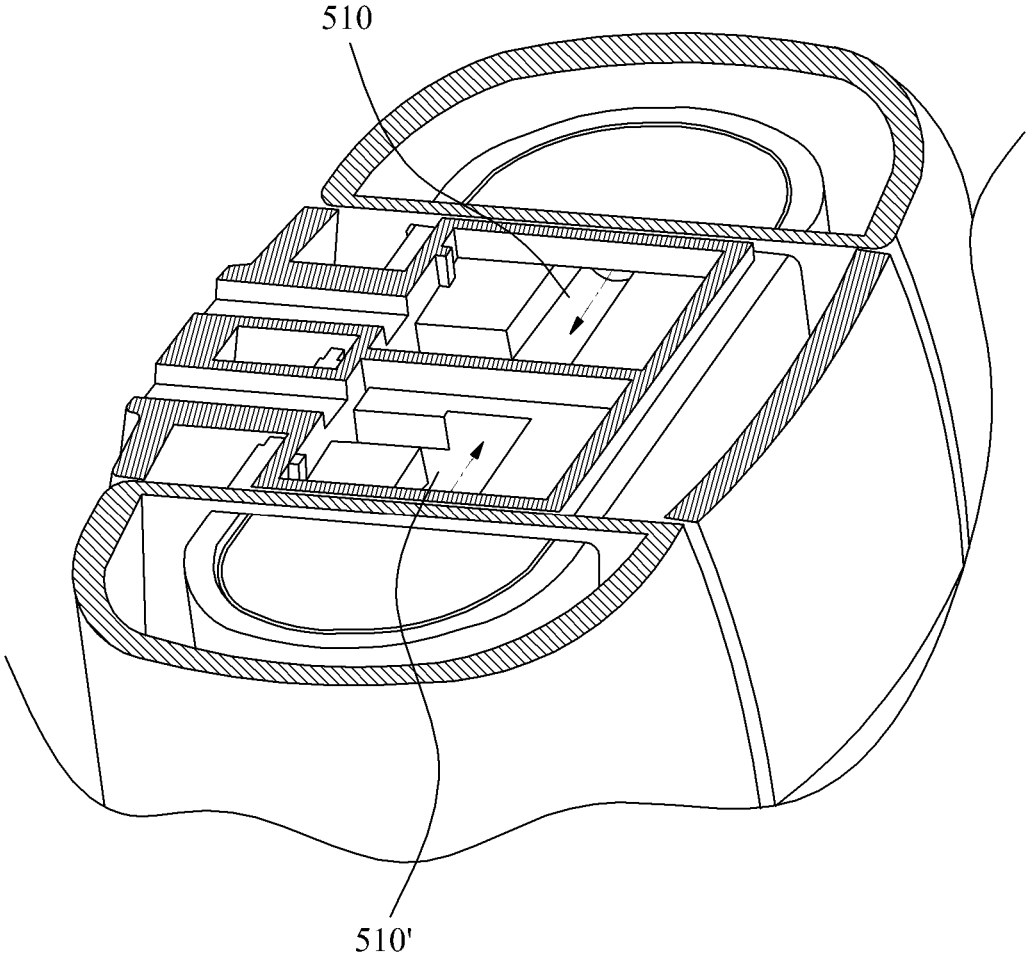

As illustrated in FIGS. 5 and 6, when a user pressurizes the pressurization part 620, the content movement part 500 coupled the pressurization part 620 descends together. Due to this, because the first pumping member and the second pumping member 300, 300' which are coupled to the lower portion of the content movement part 500 performs pumping operation simultaneously, whereby the first content and the second content M1, M2 stored in the first container and the second container 200, 200' are discharged.

At this moment, the first content and the second content M1, M2 which move to the upper portion through the first pumping member and the second pumping member 300, 300' move into the first space S1 and the second space S2 which is separately formed by the separator 621 of the pressurization part 620 through the first movement groove and the second movement groove 510, 510' of the content movement part 500, and then are respectively stored in the first space S1 and the second space S2. If the pressurization part 620 is pressurized, at this state, the first content and the second content M1, M2 which are respectively stored in the first space S1 and the second space S2 are discharged to the outside through the first discharge hole 631 and the second discharge hole 631'.

As described above, optimal embodiments have been disclosed in the drawings and the specification. Although specific terms have been used herein, these are only intended to describe the present invention and are not intended to limit the meanings of the terms or to restrict the scope of the present invention as disclosed in the accompanying claims. Therefore, those skilled in the art will appreciate that various modifications and other equivalent embodiments are possible from the above embodiments. Accordingly, the scope of the present invention should be defined by the technical spirit of the accompanying claims.

The invention claimed is:

1. A discharge container for heterogeneous contents, comprising:

a container body where liquid-type contents are stored;

a first container and a second container disposed side by side at the right and the left side at the inner side of the container body and storing a first content and a second content;

a first pumping member and a second pumping member, coupled respectively to the upper portion of the first container and the second container and discharging contents through pumping operation;

a fixation body coupled to the upper portion of the container body and fixing the first pumping member and the second pumping member to the first container and the second container;

a content movement part coupled to the upper portion of the first pumping member and the second pumping member and forming a movement passage of the first content and the second content which move to the upper portion thereof through pumping operation of the first pumping member and the second pumping member;

a button member coupled to the upper portion of the content movement part and delivering the pressure to the content movement part according to user's pressurization and guiding the first pumping member and the second pumping member to pump simultaneously and forming a first discharge hole and a second discharge hole at the front surface thereof such that the first content and the second content can be respectively discharged, and forming a first space and a second space at the inner side thereof such that the first content and the second content being discharged respectively through the first discharge hole and the second discharge hole can be stored;

and a button support body, coupled to the fixation body as encasing the button member and protrusively forming a button support protrusion that supports the button member at both sides of the button member such that vertical movement of the button member can be guided;

wherein at the upper inner side of the button member is provided a separator which extends downwards and separates the first space and the second space such that the first content and the second content can be separately stored, and at the upper end of the content movement part is formed an insertion groove where the separator is inserted.

2. The discharge container for heterogeneous contents of claim 1, wherein the button member comprises a fixation part fitted into the content movement part, a pressurization part protrusively formed upwards from the center portion of the fixation part, and an extension part having a shape corresponding to the button support protrusion and respectively extending to the front and the back of the pressurization part.

3. A discharge container for heterogeneous contents, comprising:

a container body where liquid-type contents are stored;

a first container and a second container disposed side by side at the right and the left side at the inner side of the container body and storing a first content and a second content;

a first pumping member and a second pumping member, coupled respectively to the upper portion of the first container and the second container and discharging contents through pumping operation;

a fixation body coupled to the upper portion of the container body and fixing the first pumping member and the second pumping member to the first container and the second container;

a content movement part coupled to the upper portion of the first pumping member and the second pumping member and forming a movement passage of the first content and the second content which move to the upper portion thereof through pumping operation of the first pumping member and the second pumping member;

a button member coupled to the upper portion of the content movement part and delivering the pressure to the content movement part according to user's pressurization and guiding the first pumping member and the second pumping member to pump simultaneously and forming a first discharge hole and a second discharge hole at the front surface thereof such that the first content and the second content can be respectively discharged, and forming a first space and a second space at the inner side thereof such that the first content and the second content being discharged respectively through the first discharge hole and the second discharge hole can be stored;

and a button support body, coupled to the fixation body as encasing the button member and protrusively forming a button support protrusion that supports the button member at both sides of the button member such that vertical movement of the button member can be guided;

wherein at the upper end of the content movement part are formed a first movement groove and a second movement groove which guide the first content and the second content, moving to the upper portion thereof through pumping operation of the first pumping member and the second pumping member, can respectively move to the first space and the second space.

4. A discharge container for heterogeneous contents, comprising:

a container body where liquid-type contents are stored;

a first container and a second container disposed side by side at the right and the left side at the inner side of the container body and storing a first content and a second content;

a first pumping member and a second pumping member, coupled respectively to the upper portion of the first container and the second container and discharging contents through pumping operation;

a fixation body coupled to the upper portion of the container body and fixing the first pumping member and the second pumping member to the first container and the second container;

a content movement part coupled to the upper portion of the first pumping member and the second pumping member and forming a movement passage of the first content and the second content which move to the upper portion thereof through pumping operation of the first pumping member and the second pumping member;

a button member coupled to the upper portion of the content movement part and delivering the pressure to the content movement part according to user's pressurization and guiding the first pumping member and the second pumping member to pump simultaneously and forming a first discharge hole and a second discharge hole at the front surface thereof such that the first content and the second content can be respectively discharged, and forming a first space and a second space at the inner side thereof such that the first content and the second content being discharged respectively through the first discharge hole and the second discharge hole can be stored;

and a button support body, coupled to the fixation body as encasing the button member and protrusively forming a button support protrusion that supports the button member at both sides of the button member such that vertical movement of the button member can be guided;

wherein at the inner side of the button member is provided a guide protrusion which assists the vertical movement of the content movement part, in a process that the button member ascends and descends according to the presence or the absence of the pressurization of the button member, such that the content movement part can move along together.

* * * * *